US005906027A

United States Patent [19]

Barous

[11] Patent Number: 5,906,027

[45] Date of Patent: May 25, 1999

[54] HANDLE WITH INTERCHANGEABLE IMPLEMENTS

[76] Inventor: Paul R. Barous, 313 Baywood Dr., Newport Beach, Calif. 92660

[21] Appl. No.: 08/977,265

[22] Filed: Nov. 24, 1997

[51] Int. Cl.[6] ..... A47B 95/02

[52] U.S. Cl. ..... 16/114 R; 15/145; 30/51

[58] Field of Search ..... 16/114 R, 110 R, 16/111 R, DIG. 41; 403/348, 353, 326; 15/143.1, 145, 159.1; 30/40.2, 47, 51, 526, 531, 532

[56] References Cited

U.S. PATENT DOCUMENTS

| | | | |
|---|---|---|---|
| 2,512,935 | 6/1950 | Hansen | 15/145 |
| 3,369,265 | 2/1968 | Halberstadt et al. | 15/145 |
| 3,423,781 | 1/1969 | Henson | 15/145 |
| 3,923,191 | 12/1975 | Johnson | 16/114 R |
| 4,392,303 | 7/1983 | Ciaffone | 30/51 |
| 4,554,735 | 11/1985 | Chen | 30/51 |
| 5,347,717 | 9/1994 | Ts'ai | 30/51 |
| 5,699,587 | 12/1997 | Thul | 16/114 R |

*Primary Examiner*—Chuck Y. Mah
*Attorney, Agent, or Firm*—Eric K. Satermo

[57] ABSTRACT

A handle with interchangeable and releasably attachable implements, such as a razor-blade shaving head or a toothbrush head. The handle has a body portion and a head portion. The head portion has retaining structure formed thereon. Each implement has engaging structure formed thereon. The engaging structure of the implement releasably attaches to the retaining structure of the head portion of the handle. The retaining structure may include a pair of recesses oppositely disposed in the head portion. Each of the recesses may have a slot formed in a respective side of the head portion. The engaging structure may include a pair of projections disposed in a spaced relationship on the implement. Each of the projections may including a resilient tab projecting outwardly therefrom. The recesses and the projections are configured such that when the head portion of the handle is positioned diagonally between the projections of the implement and rotated, each of the resilient tabs snaps into a respective one of the slots, thereby attaching the implement to the handle. To detach, the implement is rotated in an opposite direction to snap the tabs out of the slots.

6 Claims, 1 Drawing Sheet

HANDLE WITH INTERCHANGEABLE IMPLEMENTS

FILLED OF THE INVENTION

The present invention is directed to a handle with interchangeable implements such as a razor and a toothbrush.

BACKGROUND OF THE INVENTION

Disposable razors are commonly used at home and while traveling. Such razors are configured with a handle and fixed a razor-blade head. When the razor blade is worn out, the entire razor, including the handle and the head, is disposed of. Similarly, toothbrushes are configured with a handle and a fixed toothbrush head, and when the toothbrush is worn, the entire toothbrush is disposed of. As known in the art, the handle of a disposable razor and the handle of a toothbrush are much more durable than their respective functional heads. Accordingly, it is wasteful to dispose of a still useful handle.

Accordingly, in view of the foregoing, it is an object of the present invention to provide a substantially durable handle with disposable interchangeable implements.

SUMMARY OF THE INVENTION

This and other objects are achieved by the handle with interchangeable implements of the present invention. In a broad aspect, the a handle with interchangeable and releasably attachable implements includes a body portion and a head portion. The head portion has retaining structure formed thereon. Each implement has engaging structure formed thereon. The engaging structure of the implement releasably attaches to the retaining structure of the head portion of the handle. The retaining structure may include a pair of recesses oppositely disposed in the head portion. Each of the recesses may have a slot formed in a respective side of the head portion. The engaging structure may include a pair of projections disposed in a spaced relationship on the implement. Each of the projections may including a resilient tab projecting outwardly therefrom. The recesses and the projections are configured such that when the head portion of the handle is positioned diagonally between the projections of the implement and rotated, each of the resilient tabs snaps into a respective one of the slots, thereby attaching the implement to the handle. To detach, the implement is rotated in an opposite direction to snap the tabs out of the slots.

The interchangeable implements may include a razor-blade head and a toothbrush head. Accordingly, the handle of the present invention is conveniently used while traveling, for example. Also, the handle may be made from a substantially durable material, while the implements may be disposable. As such, only the implements need to be disposed of when worn out, which substantially reduces the amount of wasted material.

Other aspects, features, and advantages of the present invention will become apparent to those persons having ordinary skill in the art to which the present invention pertains from the following description taken in conjunction with the accompanying drawings.

DETAILED DESCRIPTION OF EXEMPLARY EMBODIMENTS

Figure 1:
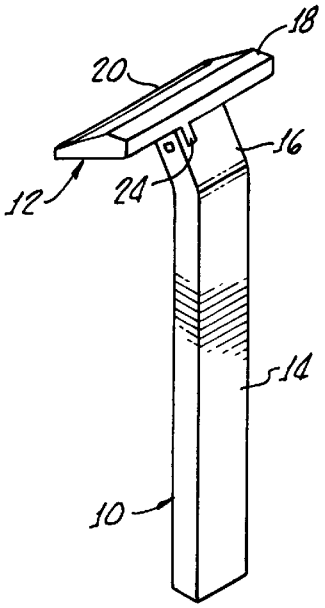
FIG. 1 is a perspective view of an exemplary embodiment of a handle with an interchangeable implement, particularly a razor head, of the present invention.

Referring to the drawings in more detail, in FIG. 1 an exemplary embodiment of a handle 10 with an interchangeable implement 12, for example, a razor head, of the present invention is illustrated. Exemplary handle 10 includes a body portion 14 and a head portion 16. Head portion 16 is disposed in an angular relationship with respect to body portion 14. Exemplary implement 12 includes a body portion 18 and a utility portion 20. Body portion 18 of implement 12 releasably attaches to head portion 16 of handle 10. Utility portion 20 of implement 12 shown in FIG. 1 is a razor blade for shaving.

Figure 2:
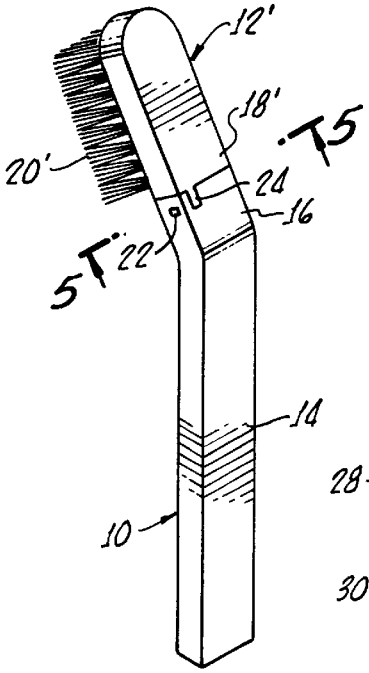
FIG. 2 is a perspective view similar to that of FIG. 1, particularly illustrating the handle with a toothbrush head.

Exemplary handle 10 illustrated in FIG. 2 is the same as that shown in FIG. 1. Implement 12' shown in FIG. 2 includes a body portion 18' and a utility portion 20' and is illustrated as a toothbrush head. Accordingly, utility portion 20' is an arrangement of toothbrush bristles for brushing teeth. Body portion 18' shown in FIG. 2 is configured slightly differently than body portion 18 shown in FIG. 1, but both portions 18 and 18' perform analogous functions of releasably attaching to handle 10. As a referencing convention used herein, elements shown in FIG. 2 which are analogous to elements shown in FIG. 1 are referenced with the like reference numerals with the addition of a prime (').

Figure 3:
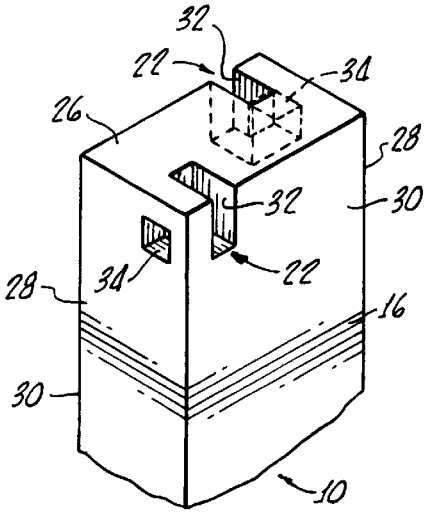
FIG. 3 is a perspective view of a head portion of the handle of the invention, particularly illustrating exemplary retaining structure.
Figure 4:
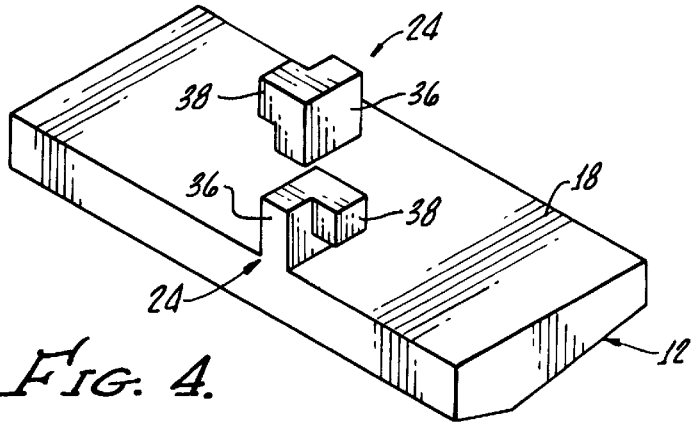
FIG. 4 is a perspective view of an implement of the invention, particularly illustrating exemplary engaging structure of the invention.

FIGS. 3 and 4 illustrate in detail exemplary retaining structure 22 formed on head portion 16 of handle 10 and exemplary engaging structure 24 formed on body portion 18 of implement 12. Retaining and engaging structure 22 and 24 are configured to enable implement 12 to releasably attach to handle 10. Head portion 16 of handle 10 has an end surface 26, a pair of opposing sides 28, and a pair of opposing faces 30.

Figure 5:
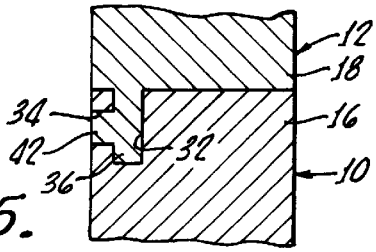
FIG. 5 is a cross-sectional view taken along line 5—5 of FIG. 2.

Exemplary retaining structure 22 may include a pair of recesses 32 formed in head portion 16. Each recess 32 may extend longitudinally from end surface 26 in a respective face 30. In addition, recesses 32 are preferably in a spaced relationship, with each recess 32 disposed near a respective side 28. Retaining structure 22 may also include a pair of slots 34. Each slot 34 extends from a respective recess 32 to a corresponding side 28. Exemplary engaging structure 24 may include a pair of projections 36 disposed in a spaced relationship on body portion 18 of implement 12. Each projection 36 may include a laterally extending resilient member or tab 38. Recesses 32 and projections 36 are spaced and configured such that each projection 36 is receivable in a respective recess 32. As shown in FIG. 5, when projections 36 are received within recesses 32, tabs 38 are respectively received in slots 34.

To attach implement 12 (or 12') to handle 10, body portion 18 of implement 12 is positioned diagonally across end surface 26 of head portion 16 with projections 36 and tabs 38 positioned adjacent to recesses 32. Implement 12 is then rotated to urge projections 36 into recesses 32 until resilient tabs 38 "snap" into slots 34. To detach implement 12 (or 12') from handle 10, implement 12 is rotated (in the opposite direction to that used to attach implement 12) until tabs 38 are urged and "snap" out of slots 34. According to the exemplary embodiment illustrated in the drawings, implement 12 is rotated clockwise to attach to handle 10 and is rotated counter-clockwise to detach from handle 10.

Handle 10 is preferably made from a durable material such as metals or engineering-grade plastics. As implements 12 may be disposable, implements 12 may be made from a less durable material than that of handle 10. In addition, at least tabs 38 of engaging structure 24 of implement 12 are made from a resilient material which allows tabs 38 to snap into and out of slots 34. In this regard, at least material defining slots 34 of retaining structure 22 may be a resilient material as well, to enhance the snapping of tabs 38 into and out of slots 34.

Those skilled in the art will understand that the embodiments of the present invention described above exemplify the present invention and do not limit the scope of the invention to these specifically illustrated and described embodiments. The scope of the invention is determined by the terms of the appended claims and their legal equivalents, rather than by the described examples. In addition, the exemplary embodiments provide a foundation from which numerous alternatives and modifications may be made, which alternatives and modifications are also within the scope of the present invention as defined in the appended claims.

What is claimed is:

1. A handle with interchangeable implements, comprising:

a handle including a body portion and a head portion, said head portion having an end surface, a pair of opposing sides, and a pair of opposing faces, said head portion having retaining structure; and an implement for attaching to said handle and including engaging structure for releasably engaging with said retaining structure of said head portion;

said retaining structure including a pair of recesses oppositely disposed in said head portion, each of said recesses having a slot formed in a respective side of said head portion;

said engaging structure including a pair of projections disposed in a spaced relationship on said implement, each of said projections including a resilient tab; and said recesses and said projections being configured such that when said head portion is positioned diagonally between said projections and rotated, each said resilient tab snaps into a respective one of said slots.

2. A handle with interchangeable implements as claimed in claim 1 wherein each said recess extends longitudinally from said end surface in a respective said face.

3. A handle with interchangeable implements as claimed in claim 2 wherein each said recess is disposed near a respective said side of said head portion.

4. A handle with interchangeable implements as claimed in claim 1 wherein said implement is a razor-blade head.

5. A handle with interchangeable implements as claimed in claim 1 wherein said implement is a toothbrush head.

6. A handle with interchangeable implements as claimed in claim 1 wherein said head portion is angularly disposed with respect to said body portion of said handle.

* * * * *